US005899843A

United States Patent [19]

Stäb

[11] Patent Number: 5,899,843

[45] Date of Patent: May 4, 1999

[54] FOLDING TABLE WITH MOVABLE DETENTS AND ITS METHOD OF OPERATION

[75] Inventor: Rudolf Stäb, Frankenthal, Germany

[73] Assignee: Koenig & Bauer-Albert Aktiengesellschaft, Wurzburg, Germany

[21] Appl. No.: 08/948,797

[22] Filed: Oct. 10, 1997

[30] Foreign Application Priority Data

Oct. 12, 1996 [DE] Germany ..... 196 42 124

[51] Int. Cl.[6] ..... B31F 1/00; B65H 45/18

[52] U.S. Cl. ..... 493/417; 493/444; 493/373; 493/472

[58] Field of Search ..... 493/417, 444, 493/342, 373, 472; 83/168, 169, 145

[56] References Cited

U.S. PATENT DOCUMENTS 5,158,524 10/1992 Muto et al. .
5,222,934 6/1993 Ochsner ..... 493/444

FOREIGN PATENT DOCUMENTS 293 327 8/1991 German Dem. Rep. .
32 39 799 1/1986 Germany .
3700603A1 1/1987 Germany .
4109730A1 3/1991 Germany .
2-66565 5/1990 Japan .
4-75964 3/1992 Japan .

*Primary Examiner*—James F. Coan
*Assistant Examiner*—Steven Jensen
*Attorney, Agent, or Firm*—Jones, Tullar & Cooper, P.C.

[57] ABSTRACT

A folding table for use in forming a third fold in a printed product, is provided with a plurality of detents that can be shifted into and out of the movement path of the product. Any accumulated paper remnants can be removed from the folding table when the detents, or selected ones of the detents are moved out of the product path. The method of operation of the device facilitates the elimination of production interruptions.

19 Claims, 2 Drawing Sheets

FOLDING TABLE WITH MOVABLE DETENTS AND ITS METHOD OF OPERATION

FIELD OF THE INVENTION

The present invention is directed generally to a folding table with movable detents, and to its method of operation. More particularly, the present invention is directed to a folding table having detents which are movable in groups or individually, and to the method of their operation. Most specifically, the present invention is directed to a method for preventing production interruption in a device, such as a folding table, for the further processing of printed products, such as signatures, and to a device including a folding table along whose top the printed products are moved, and which is provided with detents. The detents are used to stop the motion of the printed products along the folding table top and have impact surfaces. These detents are movable individually or in groups to facilitate the removal of paper scraps or remnants, which accumulate on the detent impact surfaces, without creating production interruptions.

DESCRIPTION OF THE PRIOR ART

It is well known in the field of printing to print sheets or webs and to then forward the printed sheets or cut web segments, either as individual sheets or as assembled sheet groups or signatures, to a folding table. A folding blade will then create a fold in the individual sheet or signature and will direct the folded sheet or signature to a pair of cooperating folding rollers. It is imperative that the sheets or signatures to be folded are supported on the surface of a folding table or other similar support in a proper orientation with respect to the folding blade and folding rollers. An improper positioning of the sheet or signature on the table will result in a fold line that is not properly aligned with edges of the product.

It is typical to utilize stop fingers or stop bars as detents to stop the travel of the products in the production or conveying direction prior to the creation of a fold. One prior art longitudinal folding apparatus, as is depicted in German Patent Publication DE 32 39 799 C2, discloses the use of a plurality of detents which engage a leading edge of a product which is moving in a conveying direction. These products are stopped by the detents prior to the formation of a second longitudinal fold, which is also called a third fold, in the product. Once the folding blade has engaged the now stopped products, they are longitudinally folded by the cooperative efforts of the longitudinal folding blade, and by cooperating folding rollers.

In usage of the longitudinal folding devices, such as the one discussed above, it has been noted that paper scraps and debris tend to collect on the front surface of the detents during press operation in the production of folded products. It frequently is also the case that this build-up of paper scrap or debris will not be uniform; i.e. one of the plurality of detents will experience a greater amount of build-up than will other detents. The result is that the product is halted on the folding table top in a skewed or transversely oriented manner with respect to the detents and thus also with respect to the folding blade. This results in the creation of a folded product in which the fold line is also improperly oriented. If more extensive paper scraps or remnants are built up or caught at several detents, this may result in such an inaccurate folding of the signature that the folding rollers may become jammed. This will, of course result in an extended production delay.

In accordance with present practice, the production equipment must periodically be stopped so that the accumulated paper scraps and debris can be removed from in front of the detents. Any production stoppage clearly has an adverse effect on plant output and is not desirable. In an effort to reduce these machine stoppages, the press operation may attempt to dislodge accumulated paper scraps from in front of the detents by inserting a long, thin tool through openings in the protective screens or enclosures which surround the production equipment. Such attempted solutions are not particularly successful and endanger the operation of the production equipment and may compromise the press operator's safety.

It is impossible to remove paper scraps during production by the simultaneous movement of all of the detents to a disengaged position. In the absence of the detents, the printed products will not be brought to a halt on the folding table top in a proper position and thus will not be correctly folded. Additionally, since the products to be folded move past the location of the detents once they have been moved out of the way, it is impossible to then return the detents to their proper location.

It will be seen that a need exists for an apparatus which will facilitate the removal of paper scraps without causing production delays. The folding table with movable detents, and its method of operation, in accordance with the present invention, provides such a result and is a significant improvement over the prior art.

SUMMARY OF THE INVENTION

It is an object of the present invention to provide a folding table with movable detents.

Another object of the present invention is to provide a method of operating a folding table having movable detents.

A further object of the present invention is to provide a folding table having movable detents which are movable individually or in selected groups.

Yet a further object of the present invention is to provide a method and apparatus for a folding table which facilitates the elimination of production interruption as a result of the accumulation of paper remnants or paper particles.

As will be discussed in detail in the description of the preferred embodiments of the folding table with movable detents and its method of operation in accordance with the present invention the folding table is provided with a plurality of individual detents. These detents are each mounted for movement into and out of product engaging positions. The plurality of detents can be divided into several groups, with all of the detents in each group being movable together. Alternatively, each individual detent can be shifted between an operating position and a cleaning position. The impact surfaces of the detents, against which paper scraps and debris tends to accumulate, can be cleaned as each detent is shifted to its cleaning position. Some of the detents will remain in their operating position while the other detents are being cleaned. Alternatively all of the detents can be moved out of their operating position if the product is not to be folded.

A principal advantage of the folding table with movable detents and its method of operation in accordance with the present invention is its ability to allow for the removal of small or large paper scraps or remnants, which collect in front of the detents, without requiring that the production equipment's operations be halted. The various detents are movable either individually or in groups between operating and cleaning positions. As the detents are moved to the cleaning position, they may be engaged by stripping fingers, brushes, air jets or other means for removal of the paper scraps or remnants that have accumulated. In accordance with the present invention, not all of the detents have to be moved simultaneously. This allows production to continue since selected ones of the detents will remain in place while others are moved to the cleaning position. This will insure that the product will be halted on the folding table top in the proper orientation for the third fold to be made. This prevents the transverse folding of the product, or the jamming or stuffing of the folding apparatus which has occurred in the prior art.

Another advantage of the folding table with movable detents in accordance with the present invention, and its method of operation is that all of the detents can, if desired, be removed simultaneously from their operating positions on the folding table top. If the folding table is to be used during production of a product which does not require a third fold, the detents can all be moved out of their operating positions. The product can thus pass along the folding table past the location where this second longitudinal fold would typically be affected. The product can be passed completely through the folding table without stoppage. An additional benefit is that paper particles or scraps that might have accumulated against the impact faces of the detents when the detents were in their working positions, can be swept clean of the production zone of the folding table by passage of the printed products through the zone when the detents have been pulled out of the way.

The folding table with movable detents in accordance with the present invention, and its method of operation overcome the limitations of the prior art and is a substantial advance in the art.

BRIEF DESCRIPTION OF THE DRAWINGS

While the novel features of the folding table with movable detents, and its method of operation, in accordance with the present invention, are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
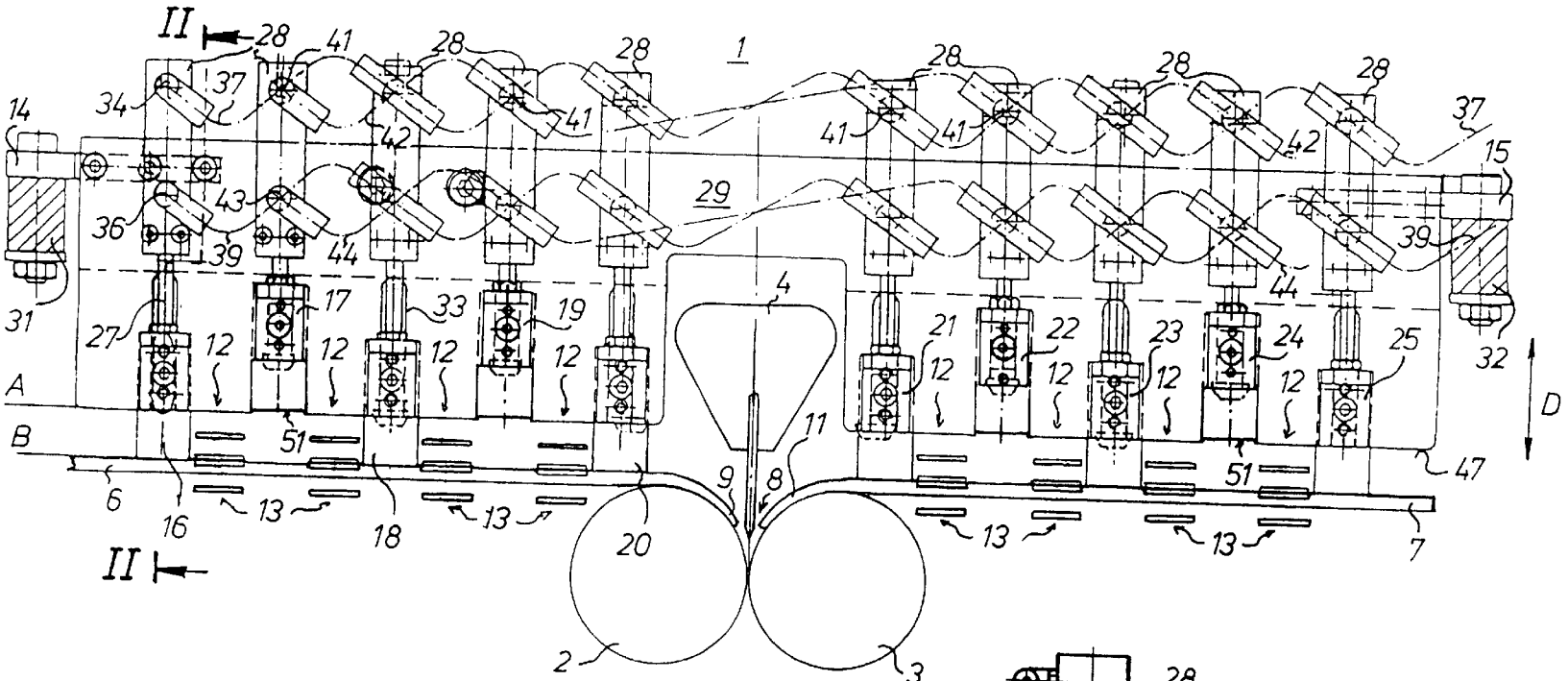
FIG. 1 is a schematic side elevation view of a longitudinal folding apparatus, viewed opposite to the feed direction of signatures to be folded, and showing the movable detents in accordance with the present invention.

Referring initially to FIG. 1, there may be seen, generally at 1, a longitudinal folding apparatus having movable detents in accordance with the present invention. The longitudinal folding device receives signatures or printed sheets, which typically have been previously provided with a first longitudinal fold and a first transverse fold in a conventional manner, and which are to be provided with a second longitudinal fold, or a so-called third fold. The signatures or sheets have been typically printed in a printing press and have been folded upstream, in the direction of product travel C by generally well known printing, forming, and folding devices that do not form a part of the present invention. Such upstream devices are well-known to those of skill in the art.

Figure 2:
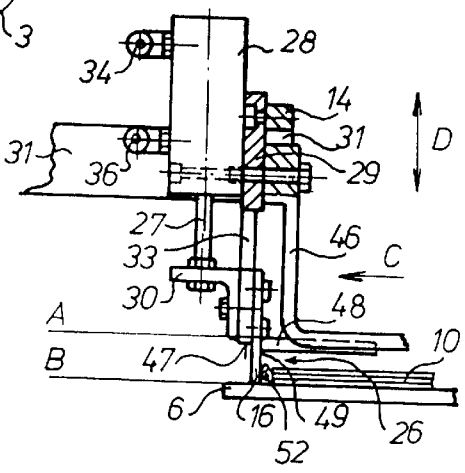
FIG. 2 is a schematic cross-sectional view of a portion of the longitudinal folding apparatus, taken along line II—II of FIG. 1 and showing a signature in place on the folding table.

Referring again primarily to FIG. 1, folding apparatus 1, which may be, for example, a longitudinal folding apparatus, consists of a driven pair of folding rollers 2, 3, a cyclically rising and descending folding blade 4, and a two part folding table 6, 7, which is seated fixed in place on a frame and which has longitudinal corners 9, 11, which are rounded in the direction of a folding gap 8. A product 10 to be imprinted, for example a signature or an individual sheet, as seen in FIG. 2, is engaged on its left and right sides, with respect to folding blade 4, by several upper conveying belts 12 and lower conveying belts 13 and is moved in the conveying direction or production direction C against impact surfaces 26 of a plurality of spaced detents 16 to 25 and is subsequently provided with a second longitudinal fold, i.e. a third fold. The longitudinal folding table is split longitudinally by the folding gap 8 into a left half 6 and a right half 7. As indicated above, these two halves 6 and 7 are supported between spaced side frames, which are not specifically shown, of the printing press assembly with which the folding apparatus 1 of the present invention is associated.

The product 10 to be folded is guided between the two conveying devices which act in parallel in respect to each other. These two conveying devices are, for example, the lower stringers of the upper conveying belts 12 and the upper stringers of the lower conveying belts 13. Suction belts, suction pushers and the like can also be employed as conveying means. The plurality of spaced detents 16 to 25 are located, spaced apart, between the upper and lower conveying belts 12, 13 and can each consist of a rectangular piece of sheet metal. The detents 16 to 25 are each connected with a linear drive. For example, they may be disposed by means of an angled holder 30 at the lower end of a piston rod 27 of a double-acting pneumatic work cylinder 28, as seen in FIG. 2. All of the work cylinders 28 are fastened to a support 29 having a width corresponding to the maximum width of the products 10 to be imprinted. On both of its sides, the support 29 is supported by brackets 14, 15 on suitable holders 31, 32, which are maintained fixed on the frame. Each one of the detents 16 to 25 disposed at the lower end of its piston rod 27 can be arranged in a height-adjustable manner; i.e. each detent 16 to 25 can be movable up and down in a vertical plane D, in a guide, for example a vertical slit 33 that is provided in the support 29. Each work cylinder 28 has two fluid connectors 34 and 36. First or upper fluid connectors 34 for the work cylinder 28 of a first group of alternate detents 16, 18, 20; 25, 23, 21 are connected by means of a first common fluid conducting tube 37 and are therefore subject to a common control command. The second or lower fluid connectors 36 are connected with a second common fluid conducting tube 39 and are also subject to a second common control command. First or upper fluid connectors 41 of the work cylinders 28 for a second group of alternate detents 17, 19; 22, 24 are connected by means of a common third fluid conducting tube 42, and second or lower fluid connectors 43 of the work cylinders 28 for the second group of detents 17, 19, 22 and 24 are connected by a fourth fluid conducting tube 44. The third and fourth fluid conducting tubes 42, 44 also respond to respectively separate control commands. The fluid conducting tubes 37, 39, 42 and 44 of the work cylinder 28 are each connected with a compressed air reservoir, not represented, and a known control device associated therewith. Supply of fluid under pressure to, or evacuation of fluid under pressure from each of the tubes 37, 39, 42 and 44 in response to operation of each tube's associated central device will cause the detents in the two groups of detents to each move either to a lower operating position B or to an upper, cleaning position A, as may be seen most clearly in FIG. 1. In the lower, work position B, the detents engage an upper surface 54 of the folding table 6 and 7. In the upper, cleaning position A, the detents are raised off the upper surface 54 of the folding tables 6 and 7. In the upper position of the detents, if all of the detents 16–25 are raised, the product 10 will pass along the folding table 6, 7 in an unrestricted fashion from an upstream position to a downstream position and will typically not be acted upon by the folding blade 4.

A right-angled holder 46 is associated with each work cylinder, as seen in FIG. 2, and extends in a direction toward the folding table 6 or 7 and is secured, by a first or vertical leg, to the back of the support 29. Its second or horizontal leg is bent off in the vicinity of a lower edge 47 of the support 29 and extends opposite to the production direction C and parallel with the top surface 54 of the folding table 6. On its lower side close to the folding table 6, 7, the cross section of this horizontal leg of the angled holder 46 can be embodied in a dovetailed manner and can receive a cleaning device, for example a stripping knife 48 which, as seen in FIG. 2, is directed toward the detents 16 to 25. The stripping knife 48 is embodied as a metal strip, which is in frictional connection at its lower edge 49, pointing in the production direction C, with the impact surface 26 of each detent 16 to 25. As the detents 16 to 25 are caused to move up to their cleaning positions A, by actuation of the work cylinders 28, these stripping knives or stripping blades 48 will scrape any accumulated paper scraps or remnants off the detents 16 to 25.

The folding table with movable detents in accordance with the present invention can operate in the following manner. In response to a control command, approximately half the number, or n/2 of the total number n of the detents 17, 19, 22, 24; 16, 18, 20, 25, 23, 21 will be located in an upper cleaning position A, i.e. they are out of contact with a product 10 to be imprinted and have been pulled upward by means of the piston rods 27 of the work cylinder 28. Therefore the mentioned number n/2, that is a group of detents 17, 19, 22, 24, i.e. approximately every second detent, will have been taken out of the path of movement C of the products 10 to be imprinted. The stripping knives 48 are, as discussed above, positioned in respect to the impact surfaces 26 of the detents 16 to 25 to engage these impact surfaces 26. During the movement of the detents 17, 19, 22, 24 from the lower operating position B into the upper cleaning position A, as depicted in FIG. 1, the lower, leading edges 49 of the strippers 48 have each respectively cooperated, in a frictionally connected manner, with the impact surface 26 of the detents 17, 19, 22, 24 in such a way, that the lower edge 51 of each of the detents 17, 19, 22, 24 was completely cleaned of paper remnants 52 which were previously lodged against the impact face 26 of each such detent, as is depicted somewhat schematically in FIG. 2.

Alternating with the previously discussed group of detents 17, 19, 22, 24, it is also possible to move the group of detents 16, 18, 20, 25, 23, 21 from a lower operating position B into an upper cleaning position A remote from the folding table top 6, 7. If products to be imprinted are not to receive an additional, or third fold, it is also possible to move all detents 16 to 25 into the upper cleaning position A. The products to be imprinted then move through the folding apparatus 1 without coming into contact with any of the detents in either of the two groups of detents.

In accordance with another configuration, a group of first detents 17, 19, 22, 24 can be fixed on a first common support, and a group of second detents 16, 18, 20, 25, 23, 21 can be fixed on a second common support. Each one of these two supports is arranged so that it can be displaced, such as, for example by being pulled up, for example on both sides, by linear drives.

Figure 4:
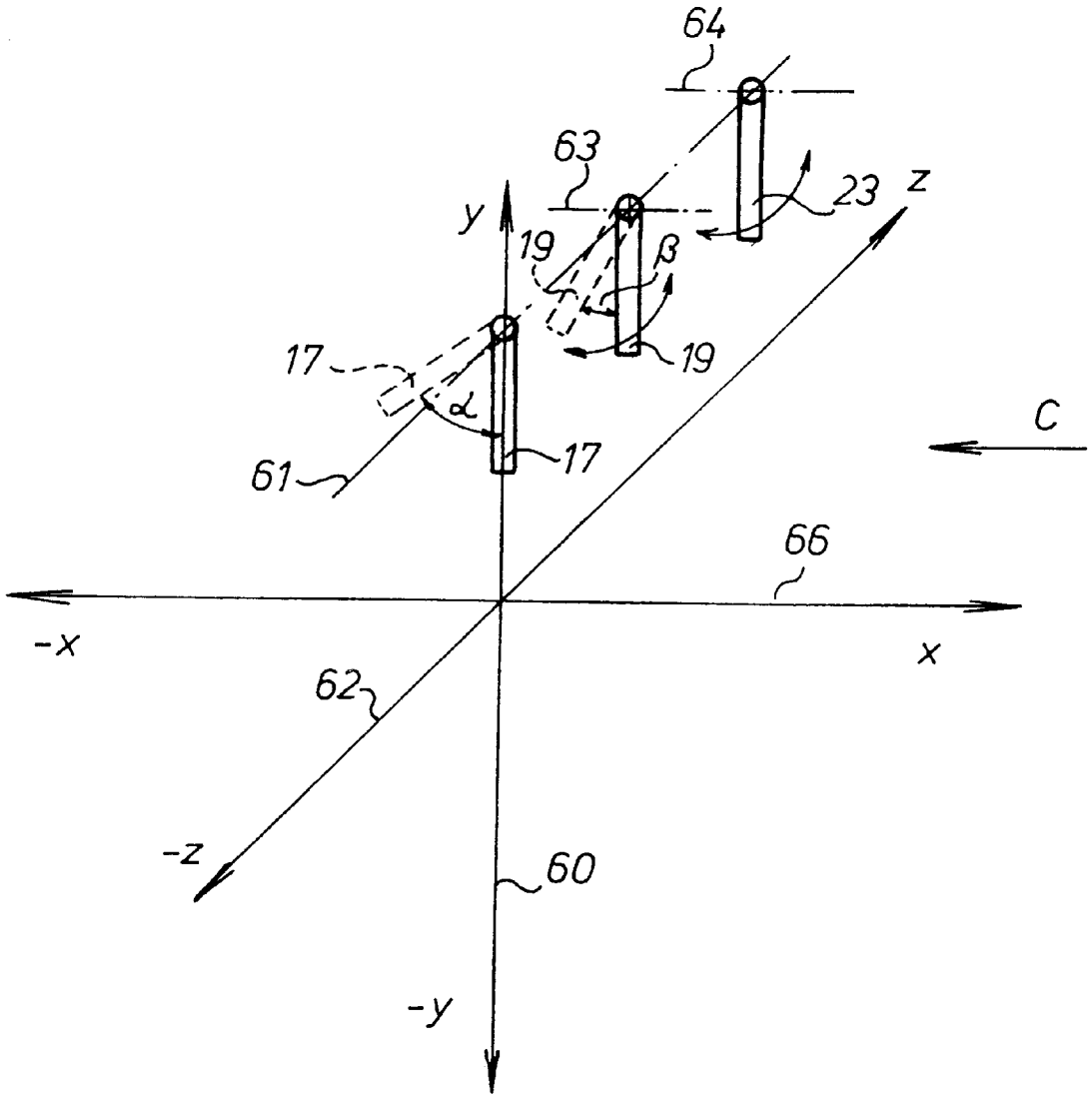
FIG. 4 is a schematic, perspective view of a plurality of detents and showing their direction of movement.

It is furthermore possible, as depicted schematically in FIG. 4, for the detents 16 to 25 to be arranged, spaced apart from each other and pivotable individually or in groups 17, 19, 22, 24; 16, 18, 20, 21, 23, 25 around a pivot axis 61 so as to be displaceable, from a vertical position of a y-axis 60, over an angle $\alpha$ in the production direction C. The pivot axis 61 extends axis- parallel with the z-axis 62 of a spatial coordinate system. This allows the lower edges of the detents 16 to 25 to be pivoted from an operating position B into a cleaning position A. The lower edges 51 of these detents 17 to 25 can be cleaned manually or by means of brushes, rotatable brush rollers or air nozzles. It is also possible to arrange the detents 16 to 25 around individual pivot axes, for example 63 and 64, as seen in FIG. 4, so they will be pivotable out of a vertical position extending parallel with the y-axis 60 over an angle $\beta$. In this case, the pivot axes 63, 64 extend axis-parallel with the x-axis 66 of a spatial coordinate system which is shown in FIG. 4.

It is possible, in accordance with the present invention, to replace the work cylinders 28 with electrical servo motors. Furthermore, in another arrangement of the cleaning device for the impact surfaces 26 of the detents 16 to 25, it is possible to attach a brush on each of the angled holders 46, wherein the brushes and the impact surfaces 26 are arranged to be frictionally displaceable in respect to each other in a vertical plane of movement D. It is easily possible to use a rotating brush, which is provided with a conventional drive, as the cleaning device for every one of the impact surfaces 26, in place of one fixed brush. In this way a rotational movement of the brush is superimposed, in addition to the linear movement B of the impact surfaces 26, onto these surfaces. Thus, as each detent 16–25 is moved up from its operating position B to its cleaning position A, the rotating cleaning brush associated with it will effectively remove any paper scraps or remnants 52.

In connection with a further assemblage of the present invention, it is also possible to arrange an air nozzle fastened on the angled holder 46 and whose nozzle orifice is directed toward the impact surface 26 of each detent, as the cleaning device for each one of the impact surfaces 26 of the detents 16 to 25. In the course of displacement of each of the detents 16 to 25 in the movement plane D from the operating position B into the cleaning position A, each impact surface 26 is cleaned of possibly adhering paper remnants 52 by an airflow, which can be switched off and which comes out of each nozzle orifice.

It is also easily possible to attach a contact-pressure brush below each one of the strippers 48, i.e. between the strippers 48 and the folding table top 6, 7. In the gaps between the adjacently arranged conveying belts 12, 13, the contact-pressure brushes press the product 10 to be imprinted against the folding table plate 6, 7.

In connection with a second preferred embodiment of the present invention, detents 16 to 25, which can be moved back and forth in a vertical movement plane D, are also provided. Impact surfaces 26 of these detents 16 to 25 each stop a product 10 to be imprinted, which was conveyed by the conveying belts 12, 13. In this embodiment, an end 53 of each detent 16 to 25 is located in a plane B that is co-extensive with the top 54 of the folding table top 6, 7, as may be seen in FIG. 3. In this second preferred embodiment of the folding table with movable detents in accordance with the present invention, in case of a collection of paper remnants 52 or paper scraps and the like at the end of one or several of the detents 16 to 25, the detent ends 53 will pass through the folding table top 6, 7 or penetrate into the folding table top 6, 7. To this end, the folding table top 6, 7 has openings 56 extending from its top 54 to its underside 57, and which have at least the cross section of a detent 16 to 25.

Figure 3:
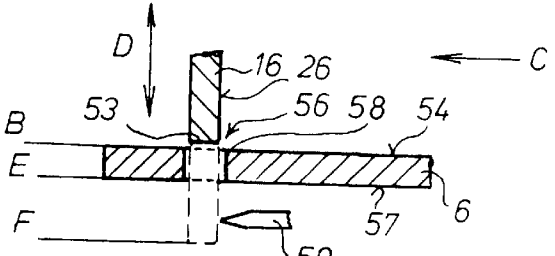
FIG. 3 is an enlarged schematic view of a portion of the folding table, again taken along line II—II of FIG. 1 and showing a second preferred embodiment of a detent in accordance with the present invention.

In accordance with a first arrangement of this second preferred embodiment, the ends 53 of the detents 16 to 25 advance from an operating position or from a plane B located on the top 54 of the folding table 6, 7, to a plane or cleaning position E located on the underside 57 of the folding table 6, 7, as shown in dashes in FIG. 3. In the process, any paper remnants are stripped away at upper edges 58 of the openings 56 which face the impact surfaces 26. By retracting the end 53 as far as above the plane B, the paper remnants can fall down through the openings 56. In place of an upper edge 58 on the folding table 6 or 7, it is also possible to provide a stripping knife, arranged in the plane B of the top 54 of the folding table 6, 7 and extending into each opening, for stripping the paper remnants off.

In accordance with a second arrangement of this second embodiment, the ends 53 of the detents 16 to 18, with the exception of ends 53 of detents 20 and 21, advance from an operating position or plane B through the plane B as far as a plane or cleaning position F. which is shown in dashed lines in FIG. 3, and which is located, for example, at a distance of the thickness of the folding table 6 below the table. In the process, any paper remnants are stripped away by a stripping knife 59, that is located below the plane F and fixed on the support. It is also possible, to first bring the detents 16 to 25, with the exception of 20 and 21, as far as the plane F and to subsequently place the stripping knife 59 against them. As indicated above, a separate cleaning device can be provided for each of the plurality of detents. Each such cleaning device can be above, inside or below the folding table top 6, 7.

In accordance with third and fourth configurations of this second embodiment, either brushes or air nozzles may be provided between the planes E and F in place of a stripping knife 59, and which act on the impact surfaces 26 of the detents 16 to 25. The drives for these brushes can be embodied the same as was described in connection with the first preferred embodiment. However, additional advantages are achieved in that it is not absolutely necessary to lift the detents 16 to 25 off the folding table 6, 7 for cleaning purposes. It is also easily possible to shift individual or only several selected detents 16 to 25 from a working position into a cleaning position at any one time.

The detents 16 to 25 cooperatively separate an accumulation space for paper scraps, dust or the like, being formed upstream of the detents, from an empty, large accumulation space, which is located downstream of the detents. If the detents 16 to 25 are, for example, moved vertically upward or downward, both accumulation spaces are united with each other and the paper scraps 52 which have collected upstream of the detents 16 to 25 can be moved to the rear, large accumulation space, from where they can be removed. All this can take place during operation, because each detent 16 to 25 can be moved, individually independently of the others or in groups, in such a way that the spaces upstream and downstream of the detents 16 to 25 can be connected with each other without hindrance.

While preferred embodiments of a folding table with movable detents and its method of operation in accordance with the present invention have been set forth fully and completely hereinabove, it will be apparent to one of skill in the art that a number of changes in, for example, the drive for the folding rollers and conveyor belts, the type of web or sheets being printed, the type of printing press being used, and the like can be made without departing from the true spirit and scope of the present invention which is accordingly to be limited only by the following claims.

What is claimed is:

1. A method for preventing production delays in a device for the processing of printed products including:

providing a folding table having a folding table top;

causing printed products to travel along said folding table top in a conveying direction;

situating a plurality of detents having impact faces on said table and separating said table into an upstream space and a downstream space in said product conveying direction;

stopping said products traveling along said folding table top by bringing said products into engagement with said plurality of detents; and removing any loose matter originating from said products and collecting on said impact faces of said detents by moving said detents from between said upstream and said downstream spaces and thereby connecting said upstream and said downstream spaces.

2. A device for preventing production delays in an apparatus for processing of printed products, said device comprising:

a folding table having a folding table top;

means to move said printed products along said folding table top in a movement direction;

a plurality of detents having impact surfaces arranged on said folding table top, said impact surfaces being engaged by said printed products to halt movement of said printed products on said folding table top; and means to selectively move at least one of said detents with respect to said folding table top to shift said at least one detent out of contact with said printed products.

3. The device of claim 2 further including a cleaning device in the area of said folding table top for each said impact surface.

4. The device of claim 2 wherein said means to move said printed product along said folding table top is a plurality of conveying belts spaced parallel to and apart from each other.

5. The device of claim 2 wherein said detents are movable vertically with respect to said movement direction.

6. The device of claim 2 wherein said detents are each pivotable about a pivot axis which extends transversely to said movement direction and parallel to said folding table top.

7. The device of claim 2 wherein each of said detents is pivotable about an individual pivot axis and further wherein each said individual pivot axis is parallel to said movement direction.

8. The device of claim 3 wherein said cleaning device is located above said folding table.

9. The device of claim 3 wherein said cleaning device is located within said folding table.

10. The device of claim 3 wherein said cleaning device is located below said folding table.

11. The device in accordance with claim 3 wherein said cleaning device is a stripping knife, said stripping knife being engageable with said impact surface of each said detent.

12. The device in accordance with claim 3 wherein said cleaning device is a brush, said brush acting against said impact surface of each said detent.

13. The device of claim 12 wherein said brush is rotatable.

14. The device of claim 3 wherein said cleaning device is an air nozzle having a controllable airflow, said air nozzle being directed against said impact surface of each said detent.

15. The device of claim 2 further including a linear drive for each said detent.

16. The device of claim 2 further including means separating said detents into groups of detents and further including a linear drive for each said group of detents.

17. The device of claim 15 wherein said linear drive is a pneumatic piston and cylinder.

18. The device of claim 15 wherein said linear drive is an electric servo motor.

19. A folding table for processing printed products comprising:

a folding table having a folding table top, said folding table top having a folding gap;

means to move printed products along said folding table over said folding gap;

a plurality of separate detents movably supported with respect to said table between an operating position and a cleaning position, each of said detents having an impact surface engageable by said printed product when each said detent is in said operating position;

means separating said detents into at least first and second groups of detents; and means for moving each of said at least first and second groups of detents separately between said operating position and said cleaning position.

* * * * *